US005379928A

United States Patent [19]

Mikkelsen

[11] Patent Number: 5,379,928

[45] Date of Patent: Jan. 10, 1995

[54] ADJUSTABLE BREAKAWAY NECK LEASH

[75] Inventor: John P. Mikkelsen, Santa Monica, Calif.

[73] Assignee: Dermalabs Research, Inc., Minneapolis, Minn.

[21] Appl. No.: 138,897

[22] Filed: Oct. 19, 1993

Related U.S. Application Data

[63] Continuation of Ser. No. 16,494, Feb. 10, 1993, abandoned, which is a continuation of Ser. No. 895,198, Jun. 5, 1992, abandoned, which is a continuation of Ser. No. 633,166, Dec. 27, 1990, abandoned, which is a continuation of Ser. No. 309,092, Feb. 10, 1989, abandoned.

[51] Int. Cl.[6] ..... A45F 3/00

[52] U.S. Cl. ..... 224/257; 224/191; 224/202; 24/3 B

[58] Field of Search ..... 224/202, 203, 205, 207, 224/219, 220, 251, 257, 258, 267, 267, 191; 206/0.81, 0.82, 37, 38, 39, 39.8, 535, 540; 24/3 B, 49 A, 49 C, 49 S, 115 F, 115 H, 115 J, 115 K, 129 W, 499, 712.2; 2/145, 148, 150, 152 R, 152 A, 156; 63/2; 222/175; D2/607, 609; D11/2, 3, 6–8; 119/96

[56] References Cited

U.S. PATENT DOCUMENTS

| | | | |
|---|---|---|---|
| D. 316,184 | 4/1991 | Mikkelsen | D3/100 |
| 782,803 | 2/1905 | Watson, Jr. | 24/115 H |
| 1,202,680 | 10/1916 | Desenfant | 24/49 S |
| 1,446,894 | 2/1923 | Foley | 206/37 R |
| 1,960,145 | 5/1934 | Edelheit | 2/145 |
| 2,571,097 | 10/1951 | Anderson | 24/49 A |
| 2,572,889 | 10/1951 | Strykower | 224/258 |
| 2,704,961 | 3/1955 | Weil | 224/202 |
| 2,846,688 | 8/1958 | Meeker | 2/150 |
| 2,890,459 | 6/1959 | Waterhouse | 2/150 |
| 2,896,217 | 7/1959 | Cedarstaff | 2/150 |
| 2,947,456 | 8/1960 | Seron | 224/258 |
| 3,034,639 | 5/1962 | Fuerste | 206/39.8 X |
| 3,065,944 | 11/1962 | Liebendorfer | 224/205 |
| 3,144,230 | 8/1964 | Brooks | 224/205 |
| 3,183,612 | 5/1965 | Romaine | 24/49 S |
| 3,204,305 | 9/1965 | Deex | 24/49 S |
| 3,225,982 | 12/1965 | Melton | 224/257 |
| 3,263,237 | 8/1966 | Bellon | 2/150 |
| 3,545,659 | 12/1970 | Libby | 224/202 |
| 3,605,384 | 9/1971 | Pacini | 119/96 X |
| 3,646,642 | 3/1972 | Sitt | 24/49 A X |
| 3,881,534 | 5/1961 | Gist | 150/33 |
| 3,999,222 | 12/1976 | Walborn | 2/150 |
| 4,023,712 | 5/1977 | Babiak et al. | 222/175 |
| 4,035,873 | 7/1977 | Epperson | 24/49 S |
| 4,038,724 | 8/1977 | Parizek | 24/49 S |
| 4,186,690 | 2/1980 | Seiler | 24/115 F X |
| 4,477,947 | 10/1984 | Lyons | 24/115 F |
| 4,804,122 | 2/1989 | Knox | 224/220 |
| 4,866,952 | 9/1989 | Hight et al. | 206/540 |
| 4,875,239 | 10/1989 | Patterson, Jr. | 2/152 R |
| 5,027,477 | 7/1991 | Seron | 24/3 B |
| 5,099,659 | 3/1992 | Carranza et al. | 63/2 |
| 5,178,311 | 1/1993 | McBride | 224/191 |

FOREIGN PATENT DOCUMENTS

| | | | |
|---|---|---|---|
| 0213876 | 11/1957 | Austria | 2/150 |
| 0070072 | 10/1949 | Denmark | 24/495 |
| 0489715 | 1/1930 | Germany | 2/150 |

*Primary Examiner*—J. Casimer Jacyna

*Attorney, Agent, or Firm*—Merchant, Gould, Smith, Edell, Welter & Schmidt

[57] ABSTRACT

An adjustable breakaway neck noose for retaining an end of a cylindrical container comprising a flexible cord of a predetermined length having an exterior surface of a woven material and having a first end and a second end which can form a noose therebetween. A holder is incorporated for holding the end of the cylindrical container having a top surface defining a raised tab and a hole transversely defined therethrough of sufficient size to receive the first and second ends of the cord, yet frictionally engage the exterior surface of the cord. The holder can be positioned along a locus of points along the length of cord so as to change the size of the noose. A bottom surface of the holder defines a cup with interior cylindrical walls sized to receive and frictionally engage the end of a cylindrical container. A clip is incorporated for clipping the first and second ends of the cord together and frictionally holding the first and second ends of the cord. The clip releases the ends of the cords when a predetermined amount of tension above one pound is exerted between the clip and the cord.

7 Claims, 2 Drawing Sheets

ADJUSTABLE BREAKAWAY NECK LEASH

This is a continuation, of application Ser. No. 08/016,494, filed Feb. 10, 1993, now abandoned, which is a continuation, of application Ser. No. 07/895,198, filed Jun. 5, 1992, now abandoned, which is a continuation, of application Ser. No. 07/633,166, filed Dec. 27, 1990, now abandoned, which is a continuation, of application Ser. No. 07/309,092, filed Feb. 10, 1989, now abandoned.

BACKGROUND OF THE INVENTION

This invention relates generally to neck leashes or nooses for retaining objects around the neck, and more particularly to those that are adjustable and can breakaway from the neck under predetermined amounts of tension.

A number of different types of various neck worn retaining devices have been available. These types of devices do not have the unique adjustability and safety of the instant invention.

A preliminary patentability search conducted in the Patent and Trademark Office was directed to the field of search encompassing Classes 224/202, 207, 219, 251, 257, 267, 901, 206/37, 38, and 540.

Below are patents found and thought to be relevant to the instant invention.

| Pat. No. | Inventor | Issue Date |
|---|---|---|
| 1,004,968 | I. L. Baugh | Oct. 3, 1911 |
| 2,704,961 | E. Weil | Mar. 29, 1955 |
| 2,756,912 | A. T. Armstrong | July 31, 1956 |
| 3,225,982 | C. M. Melton | Dec. 28, 1965 |
| 3,545,659 | W. J. Libby | Dec. 8, 1970 |
| 3,567,085 | J. G. Flores | Mar. 2, 1971 |
| 3,977,638 | J. M. Woodward | Aug. 31, 1976 |
| 4,674,298 | S. Wimmershoff-Caplan | Jun. 23, 1987 |
| 4,733,807 | R. E. Porter et al | Mar. 29, 1988 |
| 4,795,069 | H. M. Ferrill | Jan. 3, 1989 |

The Wimmershoff-Caplan, U.S. Pat. No. 4,674,298 patent is directed to an assembly including a pen having a cap designed so that the pen can be worn as part of an ornamental necklace. The assembly has a precious metal ring portion into which the cap of a writing implement such as a fountain pen can be slideably engaged or fitted.

The Ferrill, U.S. Pat. No. 4,795,069 patent is directed to a clip collar for security badges. A type of clip or clasp 22 is mounted to the badge 21 for grasping the clip 20. The clip 20 is insertable within the bore 11 of the collar 10 which passes around the neck of the user. The badge 21 is removable or releasable from the clip 20 in an easy manner.

The Porter et al, U.S. Pat. No. 4,733,807 patent is directed to a container for medicinals which passes around the neck of the user. A bottle 20 may be inserted within the holder 20 and retained thereby. Additionally, this device includes a chain 38 which passes around the neck of the user. The bottle 20 is apparently frictionally held within the holder system.

The Flores, U.S. Pat. No. 3,567,085 patent is directed to a neck-supported pill container 6 which includes an endless cord 8. The container 6 is coupled to a vial 10 and the entire device is mounted around the neck of the user, as is shown in FIG. 1. Although directed to a pill container, this device is a container member adapted for mounting around the neck of the user.

The remaining references cited above are all directed to other systems having one or more of the elements of the present invention in common. However, none of them appear to be any more relevant than those previously discussed above.

More particularly, the Wimmershoff-Caplan patent fails to disclose an adjustable neck noose and fails to disclose a neck noose that is breakaway. The Ferrill patent fails to disclose an adjustable neck noose and fails to show a breakaway noose of the type in operation in the searched invention. Just like the Wimmershoff-Caplan patent, the Porter et al patent also fails to have an adjustable neck noose and is not breakaway. Furthermore, the orientation of the holder is upward as opposed to downward and can interfere with the proper utilization of the item retained. Finally, the Flores device cannot be quickly utilized and the vial 10 must be unscrewed from its upper end. Also, no provision is made for the adjustability of the neck noose, nor does it have the breakaway aspect of the instant invention.

Other types of neck worn devices are known to be available having a cord which is securely retained to a holding means which can grasp a cylindrical object relying upon frictional engagement between inner walls of the holding device and the cylindrical object. However, the device has no adjustability in terms of the size of the neck noose and the neck noose presents danger, particularly to skiers. During skiing and other active sports often times a noose around the neck can lead to serious injury as the noose can accidentally hook on to a piece of personal equipment or a mechanical device, proving injurious and possibly fatal to the wearer. Also, during active sports or the like, the object on the end of the noose can fly up and hit the wearer in the face.

Especially considering the more active environment for outdoors sports and activities, there is a great demand for an adjustable neck noose which is breakaway under a predetermined amount of tension, yet safely retains various objects that are necessary for purposes of personal hygiene, skin protection, or lighting, among other things.

There is a potential interest in the personal products industry for such a device which can retain a object around the neck, being entirely adjustable for each individual wearer, and prevent the neck noose or object held from injuring the wearer. It is equally important that the overall appearance of the device must be aesthetic pleasing and fashionable, as well as easily and inexpensively manufactured, assembled and shipped.

The features identified above as being desirable for neck leashes for retaining objects are all provided by the present invention.

SUMMARY OF THE INVENTION

The present invention is embodied in an improved breakaway neck leash for holding objects. The invention is extremely flexible, completely adjustable, and offers a safe way for retaining various objects around the neck without the neck noose or object posing safety problems, especially in vigorous outdoor activities or in proximity to various equipment. The invention is easily manufactured and assembled and can be produced relatively cheaply. The invention is completely effective in providing access to various objects held around the neck.

More particularly, the adjustable breakaway neck leash for holding objects around the neck provides a holder for holding a portion of an object to be held having a first surface for attachment around the neck and a second surface for defining a receptacle sized to receive and hold the portion of the object. A cord for engaging the holder forms a noose, wherein a piece of cord engages the first surface of the holder and is retained thereby. The cord has two joinable ends which dissociate when a predetermined amount of tension is exerted on the cord.

The first surface of the holder defines a hole transversely positioned through the holder, having a size to receive a piece of the cord passing through the hole and be retained thereby. The first surface is an upper surface, wherein the second surface of the holder is a bottom surface. The receptacle has interior vertical walls for frictionally engaging the portion of the object to be held. When in an assembled condition, the portion of the object hangs substantially below the holder while the holder hangs substantially below the noose when properly worn around the neck.

The interior vertical walls of the receptacle may vary in diameter within the receptacle. The receptacle is flexible and sized so as to allow the portion of the object to be frictionally held by the interior walls of the receptacle when the portion of the object to be held is pushed into the receptacle of the holder. The portion of the object can be dissociated from the receptacle by a downward force of a predetermined amount which may be less than the amount of the predetermined amount of tension which allows the neck leash to breakaway.

The interior vertical walls of the receptacle of the holder define an inwardly positioned lip which frictionally engages the portion of the object to be held. The holder also defines a upraised tab on the first surface defining the hole therethrough retaining the cord.

Inner walls of the hole frictionally engage an outer surface of the cord, allowing the positioning of the holder at selected points along the cord. Thus, the holder can be adjusted to shorten the noose and prevent the object being held from bouncing up into the face of the wearer.

The neck leash further comprises at least one retaining means or clip for retaining at least one of the two joinable ends of the cord together at a predetermined point along each of the two ends, respectively.

One or two clips may be used to retain the ends of the cord. One clip can be used to retain both ends of the cord together, or two clips, one for each end of the cord, individually. In any event, the clips are sized so as to prevent their passage through the hole of the holder.

The clip or clips have a first surface and a second surface hingedly joined together. The first surface has a protruding post while the surface tab has a corresponding slot sized to engage and frictionally hold the protruding post when the first surface is hingedly closed or folded over upon the second surface. One or both ends of the cord are held between the first and second surfaces, frictionally holding one or both ends of the cord therebetween. Exertion of the predetermined amount of tension upon the cord causes at least one end of the cord to pull free from a clip, thereby breaking away and releasing the noose from the neck of wearer.

Alternatively, a sleeve or sleeves can be used. The sleeve has an inner and outer diameter, wherein the ends of the cord are retained within the inner diameter of the sleeve and the outer diameter of the sleeve is greater than the diameter of the hole in the tab of the holder, thereby retaining the cord to the holder in the absence of a predetermined amount of tension exerted upon the cord. The ends of the cord can, of course, pull free from the sleeve or sleeves under that amount of tension.

The holder is made of an elastomeric material integrally molded in a bell shape. The cord is flexible, while the retaining means is plastic.

The cord can be a woven material or the like, while the ends of the cord are partially crimped to prevent unraveling.

Other aspects and advantages of the present invention will become apparent from the following description of the preferred embodiments taken in conjunction with the accompanying drawings, which illustrate, by way of example, the principles of the invention.

DESCRIPTION OF THE PREFERRED EMBODIMENTS

Figure 1:
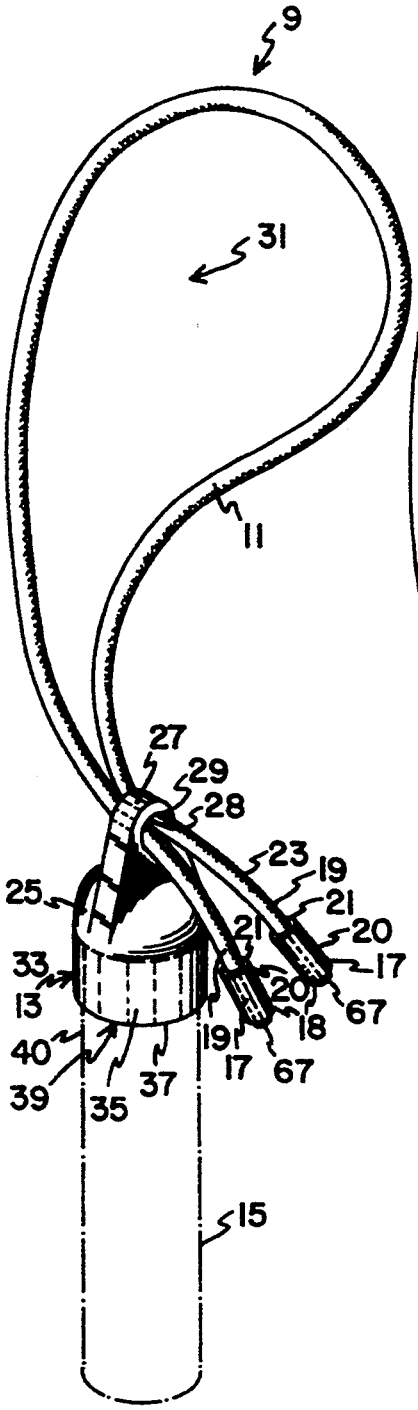
FIG. 1 is a top right perspective view of the adjustable breakaway neck leash of the present invention, with a cylindrical object to be held shown in phantom lines.
Figure 5:
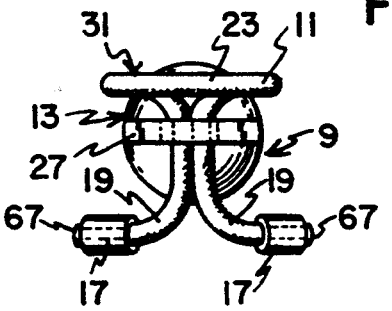
FIG. 5 is a top plan view of the embodiment of the adjustable breakaway neck leash of the invention shown in FIG. 1.
Figure 6:
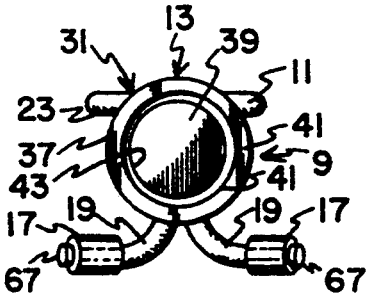
FIG. 6 is a bottom plan view of the embodiment of the adjustable breakaway neck leash of the present invention shown in FIGS. 1 and 5.

As shown in the drawings, wherein like numerals represent like elements throughout, the invention is embodied in a first preferred embodiment having the reference numeral 9 shown in FIGS. 1, 5, and 6. The invention comprises a flexible cord 11 which is detachably attached to a holder 13 of a predetermined configuration so as to hold an object 15 shown in phantom lines in FIG. 1. Retaining sleeves 17 frictionally engage the ends 19 of the cord 11. Inner diameters 18 of the sleeves 17 are sized to frictionally engage an exterior surface 23 of the cord 11.

As shown in FIGS. 1 and 5, the holder 13 has a top end 25 defining an upraised tab 27 further defining a hole 29 transversely therethrough and horizontally positioned, and sized to allow the ends 19 of the cord 11 to pass through the hole 29. However, a diameter 28 of the hole 29 is sized so as to frictionally engage the exterior surface 23 of the cord 11. Therefore, a noose 31 is defined by the cord 11 in association with the holder 13. The noose 31 can be adjustably varied by sliding the two ends 19 of the cord 11 through the hole 29. The exterior surface 23 of the cord 11 can be textured or of a woven material, fabric, synthetic material such as polyester strands or the like so as to frictionally engage the cord 11, yet still allow adjustability of the noose 31.

Outer diameters 20 of the sleeves 17 are sized to prevent the passage of the sleeves 17 through the hole 29 in the holder 13. When a predetermined amount of tension is placed on the noose 31, one or both ends 19 of the cord 11 will pull through the hole 29 until the sleeve or sleeves 17 are encountered. The sleeves 17 will then dissociate from the ends 19 of the cord 11 allowing the cord 11 to breakaway from the neck of the wearer.

An upper surface 33 of the holder 13 can be exteriorly curved for styling and so as to avoid sharp edges which could be dangerous in the event the holder slips, bounces or is blown up into the eye of the wearer under rigorous activities or inclement weather. Also, a lateral surface 35 may be cylindrical for styling and ease of gripping the holder 13 when attempting to detach the cylindrical object 15 from the holder 13.

As shown in FIGS. 1 and 6, a bottom end 37 of the holder 13 defines a receptacle 39 for receiving a first end 40 of the cylindrical object 15. The receptacle 39 defines interior vertical walls 41 which are sized to complement the first end 40 of the cylindrical object 15. Additionally, portions of interior vertical walls 41 may be of a lesser diameter.

As shown in FIG. 6, a lip 43 can be incorporated within the receptacle 39 to sufficiently and frictionally engage the first end 40 of the cylindrical object 15. The cylindrical object 15 is engaged by the holder 13 by pushing the first end 40 of the cylindrical object 15 into the receptacle 39 sufficiently forceful to engage the lip 43, as well as the interior vertical walls 41. Preferably, the holder 13 is integrally formed of an elastomeric material such as 70 Neo-prene which is sufficiently flexible and has an adhesive surface so as to sufficiently engage smooth surfaces of objects to be held. For purposes of ornamental appearance, the holder 13 can have an overall bell shape and can be of a variety of different colors depending upon the appeal of the person wearing the invention 9.

Figure 2:
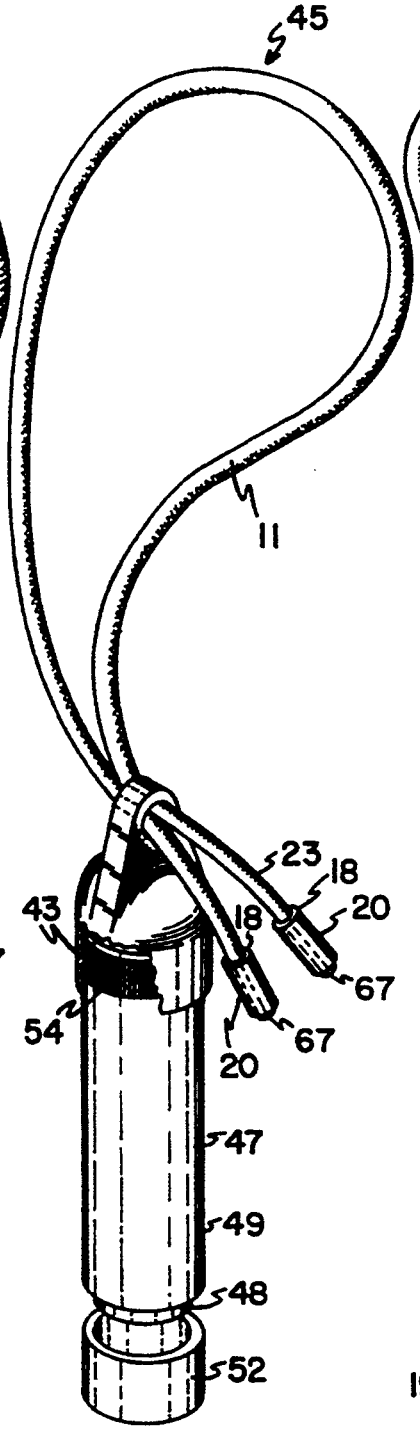
FIG. 2 is a top right perspective view of the adjustable breakaway neck leash of the present invention shown holding a lip balm dispenser partially exploded, together forming a dispensing system of the present invention.

In a second preferred embodiment of the invention as shown in FIG. 2 and having the reference numeral 45, the invention comprises an overall dispensing system 45. A portion of the dispensing system 45 is very similar to the first embodiment 9 of the invention as shown in FIG. 1. However, a lip balm dispensing stick or "chapstick" 47 is incorporated therewith. The dispensing stick or "chapstick" 47 is commonly known in the art as comprising a cylindrical container 49, solid but softened lip balm 48 within the container 49, and a cap 52 for closing the cylindrical container 49 holding the lip balm 48 within. Furthermore, a dispensing dial, not shown, has vertical knurled edges which can be rotated to dispense the lip balm 48 from the cylindrical container 49. Again, the operation, structure, and features of the "chapstick" or lip balm dispensing stick 47 are commonly known in the art and will not be further herein discussed. However, in the context of the dispensing system 45 shown in FIG. 2 it should be noted that FIGS. 5 and 6 are applicable to the structure and function of the holder 13. More particularly, the knurling on the dispensing dial 54 of the "chapstick" 47, more readily engages the lip 43 of the receptacle 39 of the holder 13 and provides an excellent securement therebetween. Also, it should be noted that the force required to separate the cap 53 from the cylindrical container 49, may preferably be less than that force that would cause the dissociation of the "chapstick" or dispensing stick 47 from the holder 13.

Figure 3:
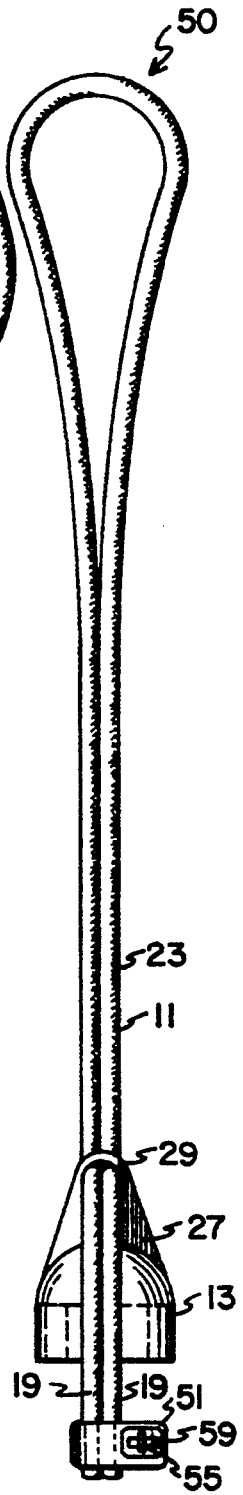
FIG. 3 is a right elevational plan view of another embodiment of the adjustable breakaway neck leash of the present invention.

A third preferred embodiment of the invention shown in FIG. 3 and indicated by the reference numeral 50 is similar to the embodiments shown in FIGS. 1, 2, 4, 5 and 6. However, a single clip 51 is used to retain the ends 19 of the cord 11. Like the sleeves 17 of the first and second preferred embodiments shown in FIGS. 1, 2, 5 and 6, the clip 51 frictionally engages the exterior surface 23 of the cord 11. Also, the clip 51 is sized to prevent passage of the clip 57 through the hole 29 in the tab 27 of the holder 13.

Figure 4:
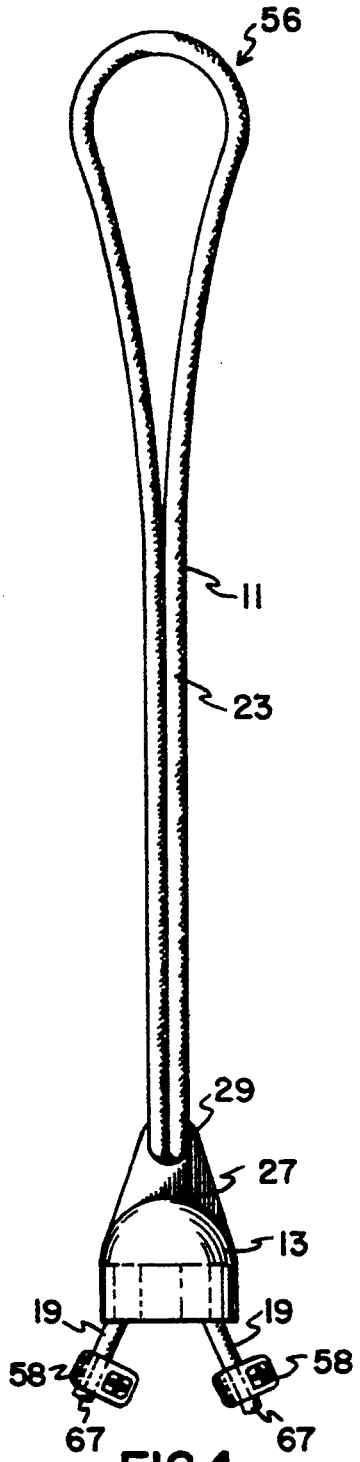
FIG. 4 is a left elevational plan view of still another embodiment of the adjustable breakaway neck leash of the present invention.

As shown in FIG. 4, a fourth preferred embodiment of the invention indicated by the reference numeral 56 uses two clips 58 similar to the clip 51 used in the third preferred embodiment 50 of the invention shown in FIG. 3. Of course, the clips 58 shown in FIG. 4, may be a smaller size than that clip 51 shown in FIG. 3. However, whether one or two clips are used, the size or combined size of the clip 51 or clips 58 must be sufficiently great so as to prevent its or their passage through the hole 29 in the tab 27 of the holder 13, respectively.

Figure 7:
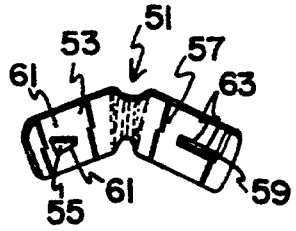
FIG. 7 is a top perspective view of a clip used in the embodiments of the adjustable breakaway neck leash as shown in FIGS. 3 and 4.

A great number of different clips can be used so as to provide frictional engagement between the exterior surface 23 of the cord 11 and the clip 51 or clips 58. An effective clip incorporated by the third embodiment 50 the fourth embodiment 56 of the present invention shown by FIGS. 3 and 4, respectively, is shown in more detailed aspects in FIG. 7. The clip 51 is known in the art of paper clips as a "Klipple" for securely clipping at least two pieces of paper together. A first surface 53 defines a protruding post 55. A second surface 57 is hingedly joined to the first surface 53 and further defines a complementing slot 59 sized and positioned to frictionally engage the protruding post 55 in a closed position. The clip 51 is fastened or closed around one or two ends 19 of the cord 11 by folding the first surface 53 over the second surface 57 and pushing the protruding post 55 into the slot 59. The protruding post 55 may have outwardly tapered sides 61 to frictionally and firmly engage inner walls 63 of the slot 59.

Similarly, the sleeve or sleeves 17 as shown in the first and second preferred embodiments of the invention of FIGS. 1, 2, 5 and 6 must be able to pull free or disengage from the ends 19 of the cord 11 under the predetermined amount of tension so as to achieve the breakaway effect.

The clip 51 or clips 58 of the present invention when in a closed and assembled condition around the ends 19 of the cord 11 should have sufficient frictionally retaining force to withstand an amount of tension between three and seven pounds between the cord 11 and the clip 51 or clips 58. A breakaway tension of five pounds seems to be an effective value for most applications.

It should be noted that the pullaway force of the cylindrical object 15 or the "chapstick" 47 from the holder 13 should be less than the breakaway tension of the clip 51 or clips 58 from the cord 11. If not, the cord 11 may pull away from the holder 13 whenever the wearer decides to dissociate the cylindrical object 15 or the "chapstick" 47 from the holder 13 causing the breakaway effect. Depending upon the object to be held and the activities of the wearer the wearer this criteria may not be as important.

A very important aspect of the invention is its ornamental appearance for those fashion conscious individuals. The cord 11 can have a variety of different colors as can the holder 13. The respective colors or designs of each can be matching colors and/or complementary colors and/or designs. Because of the unique configuration of the invention, the holder 13 can be moved up or down the cord 11, shortening or lengthening the noose 31. Shortening the noose 31 gives the appearance of a Western necktie. Also, the object 15 to be held is held firmly against the neck preventing any bouncing up of the object into the face of the wearer.

The sleeves 17, clip 51, or clips 58 should have an ornamental appearance and can be of a variety of different configurations in form and be of different colors or designs so as to provide greater aesthetic appeal. Also, tips 67 of the ends 19 of the cord 11 may be crimped or heat fused so as to have a neat appearance.

It should be appreciated from the foregoing description that the present invention provides an improved adjustable breakaway neck leash, which is simple in construction, yet completely effective in holding a cylindrical object or lip balm dispensing stick in a secured position around the neck without jeopardizing the safety of the wearer. The adjustable breakaway neck leash can be ornamentally worn, has complete adjustability and can pull free from the neck in the event of unexpected tension placed upon the cord 11. The present invention allows the object to be held to hang downwardly as shown in FIG. 1 and FIG. 2 so as to apply lip balm or the like to the wearer without removing the lip balm dispensing stick or "chapstick" 47 from the holder 13. The invention is easily and inexpensively manufactured, assembled and shipped.

Although the present invention has been described in detail with reference only to the presently-preferred embodiments, it will be appreciated by those ordinarily skilled in the art that various and numerous modifications can be made without departing from the invention. Accordingly, the invention is limited only by the following claims.

I claim:

1. A safety leash for holding a portion of an object of predetermined size, comprising:

flexible cord means defining an outer surface and having first and second ends;

holder means comprising object holding means sized to receive and retain the portion of said object and a member having an opening with inner walls formed therethrough, the first and second ends of the cord means being insertable through said opening with the inner walls of said opening frictionally engaging the outer surface of the cord means, allowing the positioning of the holder means at a selected point along said cord means to form an adjustable noose which can be worn around the neck of the user, said object holding means comprising a receptacle having interior substantially vertical walls sized to receive and hold the portion of the object and allowing the object to hang substantially below the holder means while said holder means hangs substantially below said noose when properly worn; and retaining means releasably secured to at least one of said first and second ends of the cord means, said retaining means being larger than said opening and being disconnectable from the cord means in the presence of a force of predetermined magnitude to permit withdrawal of the cord means from said opening, the retaining means comprising a clip having first and second members hingedly joined together along an adjacent edge, said first member having a protruding post, said second member having a slot sized to receive and frictionally hold said protruding post when said first member is hingedly folded over upon said second member around at least one of said two ends of said cord means, frictionally holding at least one of said two ends of said cord means therebetween.

2. A neck leash as claimed in claim 1, wherein said interior walls of said receptacle vary in diameter within said receptacle, said receptacle being flexible so as to allow the portion of the object to be frictionally held by said interior walls of said receptacle when the portion to be held is pushed into said receptacle of said holder means, allowing the object to be dissociated from said receptacle by said predetermined force.

3. A neck leash as claimed in claims 2, wherein said interior walls of said receptacle of said holder means include an inwardly positioned lip so as to releasably and frictionally engage the portion of the object to be held, and the holder means includes an upraised tab defining said opening therethrough.

4. A neck leash as claimed in claim 1, wherein said holder means is made of an elastomeric material and integrally molded in a bell shape, said cord means is flexible and said retaining means is plastic.

5. A neck leash as claimed in claim 4, wherein said cord means is a woven material or the like, wherein said two ends of said cord means are partially crimped to prevent unraveling.

6. A neck leash as claimed in claim 1, wherein the object holding means is constructed and arranged so that the object can be disconnected from the holder means upon pulling the object under a predetermined force.

7. A neck leash as claimed in claim 6, wherein the predetermined force necessary to disconnect the cord means from the holder means is more than the predetermined force necessary to disconnect the object from the holder means.

* * * * *